US005893780A

United States Patent [19]

Durand-Cochet

[11] Patent Number: 5,893,780

[45] Date of Patent: Apr. 13, 1999

[54] ELECTRICAL CONNECTOR

[75] Inventor: Fabrice Durand-Cochet, Rambouillet, France

[73] Assignee: Connecteurs Cinch, Societe Anonyme, Montigny Le Bretonneux, France

[21] Appl. No.: 08/778,691

[22] Filed: Jan. 3, 1997

[30] Foreign Application Priority Data

Jan. 25, 1996 [FR] France ..... 96 00873

[51] Int. Cl.[6] ..... H01R 13/514

[52] U.S. Cl. ..... 439/752

[58] Field of Search ..... 439/752, 752.5, 439/839, 843

[56] References Cited

U.S. PATENT DOCUMENTS

| | | | |
|---|---|---|---|
| 3,237,148 | 2/1966 | Ege | 439/752 |
| 5,007,865 | 4/1991 | Jakobeit | 439/839 |
| 5,362,261 | 11/1994 | Puerner | 439/752 |
| 5,591,051 | 1/1997 | Ittah | 439/752 |
| 5,624,285 | 4/1997 | Pethieu et al. | 439/752 |
| 5,634,826 | 6/1997 | Jean et al. | 439/752 |

FOREIGN PATENT DOCUMENTS

| | | |
|---|---|---|
| 0056209 | 7/1982 | European Pat. Off. . |
| 0658952 | 6/1995 | European Pat. Off. . |
| 3705739 | 8/1987 | Germany . |
| 4312641 | 10/1994 | Germany . |

*Primary Examiner*—Paula Bradley
*Assistant Examiner*—Tho Dac Ta
*Attorney, Agent, or Firm*—Greenblum & Bernstein, P.L.C.

[57] ABSTRACT

Electrical connector comprises a housing member having a series of passages each of which receives a female electrical contact member having a profiled part which cooperates with a locking key mobile in a slot perpendicular to the passages and having a series of slots aligned with the passages, each female electrical contact member including a boss which cooperates with a guide slot of each passage and a retaining tongue cut out from a lateral wall and the free end of which is at the same end as the profiled part. The part of each passage between the insertion end and the slot includes a recess the depth of which increases in the direction towards the slot and wherein the retaining tongue is housed.

22 Claims, 6 Drawing Sheets

FIG.1
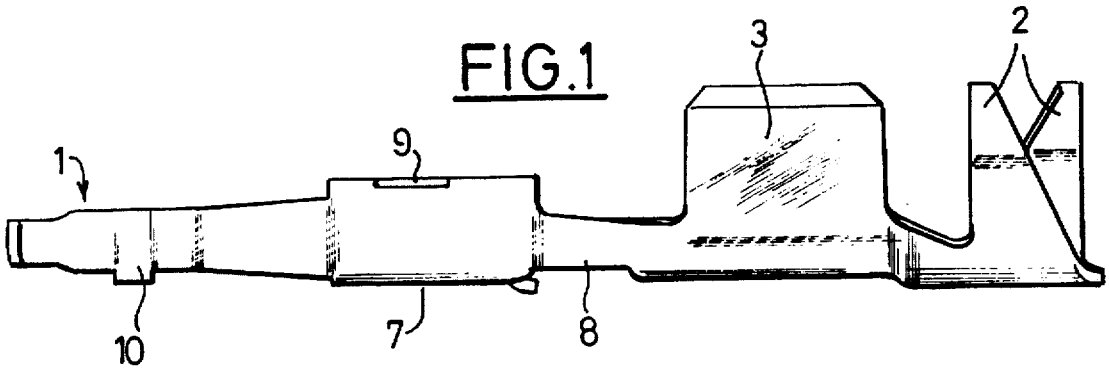
FIG.2
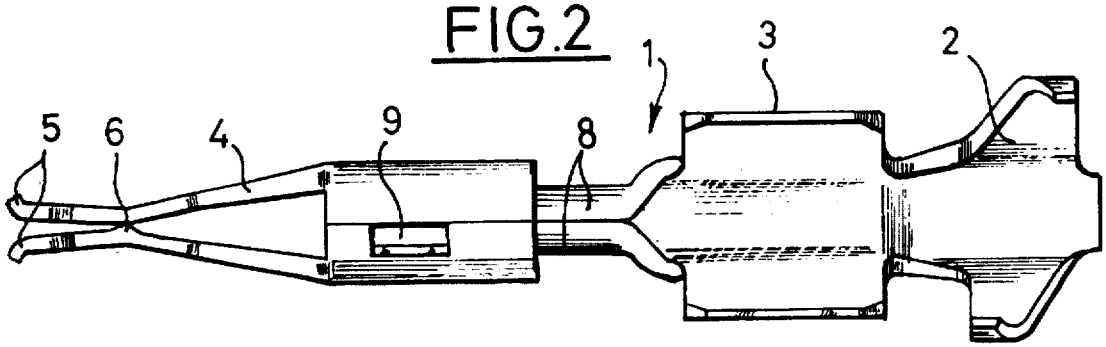
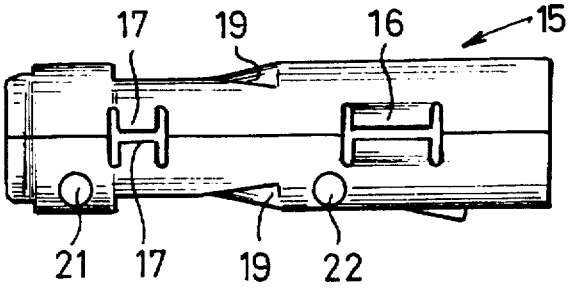
FIG.3
FIG.4
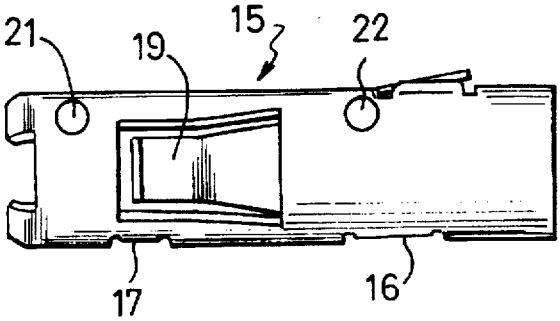

ELECTRICAL CONNECTOR

BACKGROUND OF THE INVENTION

1. Field of the Invention

The present invention concerns an electrical connector.

2. Description of the Prior Art

The invention relates to an electrical connector of the type comprising a housing member with passages each adapted to receive a female electrical contact member having at one end lugs for crimping it to an electrical conductor and at the other end a spring clamp adapted to grip a male strip.

The housing member has a transverse slot in which moves a locking key provided with slots the edges of which cooperate with a profiled part of each female electrical contact member so that once the members are fitted they cannot be removed without removing the key from the slot.

In this type of connector a retaining tongue is cut out from the lateral wall of the female electrical contact member on the same side as the spring clamp and directed towards the profiled part, this tongue constituting a detent for retaining the member in the corresponding passage.

As each member must occupy a particular angular position within the corresponding passage, the latter is provided with a longitudinal groove and each member is provided with a boss cooperating with the groove.

It has been found that, during fitting of the female electrical contact members, when they line up with the slot, the retaining tongues tend to move them out of alignment with the passages. The ends of the members having the spring clamp may then not engage in the corresponding end of the passages, or engage therein only with difficulty.

It has also been found that, on demounting the female electrical contact members, the free end of the retaining tongue may abut against the edge of the corresponding passage opening into the slot, so that there is a risk of the electrical contact members being impossible to remove.

One aim of the invention is to overcome these drawbacks.

SUMMARY OF THE INVENTION

The invention consists in an electrical connector comprising a housing member having a series of passages each adapted to receive an insertion end of a female electrical contact member, a locking key mobile in a slot perpendicular to the passages and having a series of slots aligned with the passages, each female electrical contact member comprising a first part with a spring clamp at one end and lugs for crimping an electrical conductor at the other end and a second part constituted by a sleeve fixed over the first part at the end opposite the crimping lugs and including elastic tongues cooperating with the spring clamp, a profiled part being formed between the corresponding end of the sleeve and the crimping lugs, this part being inserted in the slots in the locking key, the sleeve including a boss adapted to cooperate with a guide slot of each passage and a retaining tongue cut out from a lateral wall and the free end of which is at the same end as the profiled part, in which connector the part of each passage between the insertion end and the slot includes a recess the depth of which increases in the direction towards the slot and wherein the retaining tongue is housed.

Accordingly, by virtue of the invention, the retaining tongue is free in that part of the travel of the electrical contact member in which the sleeve crosses the slot.

To demount a female electrical contact member, the retaining tongue is pushed back, cooperating with the recess with no risk of catching.

Another advantage of the invention is that the retaining tongue, in cooperating with the recess, provides enhanced guidance of the female electrical contact member.

Also, the forces on inserting and extracting the female electrical contact member are regularly distributed over all of its travel.

In accordance with one design feature, the end of the recess adjacent the slot is parallel to the longitudinal axis of the passages.

To enhance the guidance of the electrical contact members in the passages, the sleeve incorporates a second boss, the distance between the two bosses being greater than the width of the slot.

Finally, in accordance with a final feature, when the connector is of the type in which each passage includes two grooves offset 180° so that each female electrical contact member can be inserted in two different angular positions, each passage includes two recesses offset angularly by 180°.

The invention will now be described in more detail with reference to a particular embodiment shown by way of example only in the appended drawings.

BRIEF DESCRIPTION OF THE DRAWINGS

FIG. 1 is a front elevational view of a first part of a female electrical contact member of the invention.

FIG. 2 is a corresponding top plan view.

FIG. 3 is a front elevational view of the second part of the female member.

FIG. 4 is a corresponding top plan view.

DETAILED DESCRIPTION OF THE PREFERRED EMBODIMENTS

Figure 5:
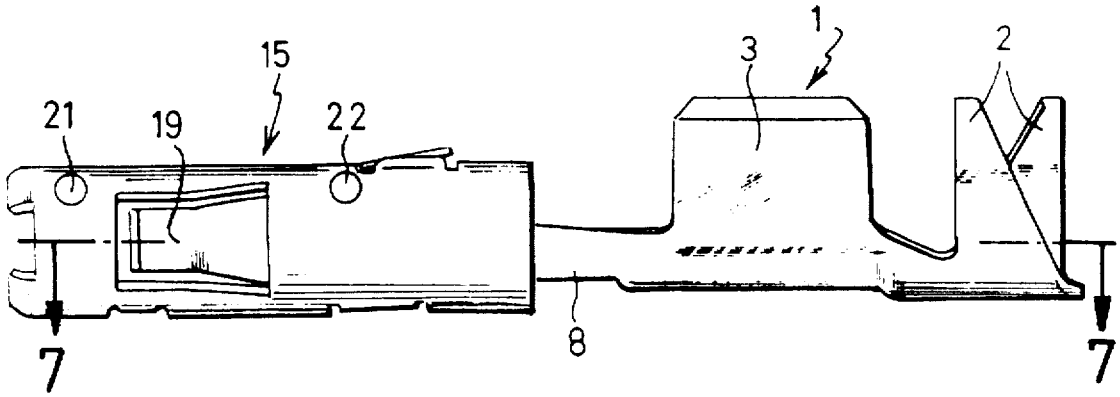
FIG. 5 is a front elevational view of the female electrical contact member when fitted.

The first part 1 of the female electrical contact member is cut out and shaped so as to have at one end two crimping lugs 2 for gripping an electrical conductor and two crimping lugs 3 for gripping a bared end of the conductor.

At the end opposite the lugs 2 are two spring strips 4 adapted to form a spring clamp 5 having free ends; and for gripping a flat male electrical contact member.

The free ends 5 of the spring strips 4 are bent outwards and stamped protrusions 6 are formed on their sides that face each other.

Between the spring strip 4 and the lugs 3 the member 1 has a rolled part 7 and a profiled part 8, with a notch 9 in the part 7.

Each strip 4 has a projection 10 along one edge.

The second part of the electrical contact member is formed by a sleeve 15 adapted to fit over the part 7 with lugs 16 adapted to engage in the notch 9.

Lugs 17 cut out from the sleeve 15 are adapted to cooperate with the projections 10.

Two complementary spring strips 19 are formed in the sleeve 15 and are adapted to bear against the strips 4 to reinforce the spring action of the latter.

The sleeve 15 includes two bosses 21 offset angularly by 180° near the free ends 5. Two other, circular bosses 22 are formed partway along the sleeve 15, aligned with the bosses 21.

Figure 6:
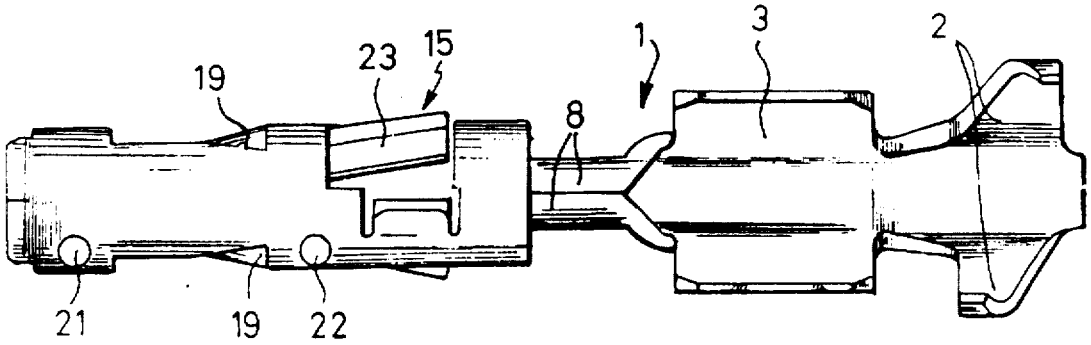
FIG. 6 is a corresponding top plan view.
Figure 7:
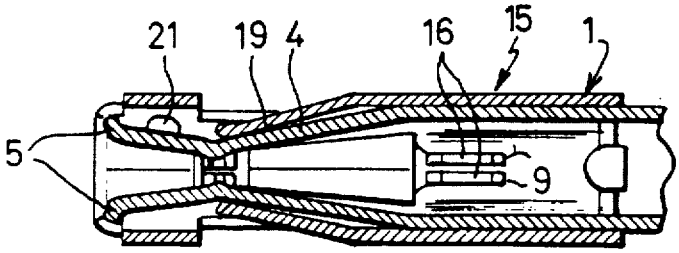
FIG. 7 is a view in section on the line 7—7 in FIG. 5.

A retaining tongue 23 (see FIG. 6) forming a detent is cut out from the wall of the sleeve 15 and its free end faces towards the profiled part 8 of the part 1.

An insertion end 24 of the electrical contact member is adapted to be inserted in passages 26 of a housing member 27 of an electrical connector.

Figure 8:
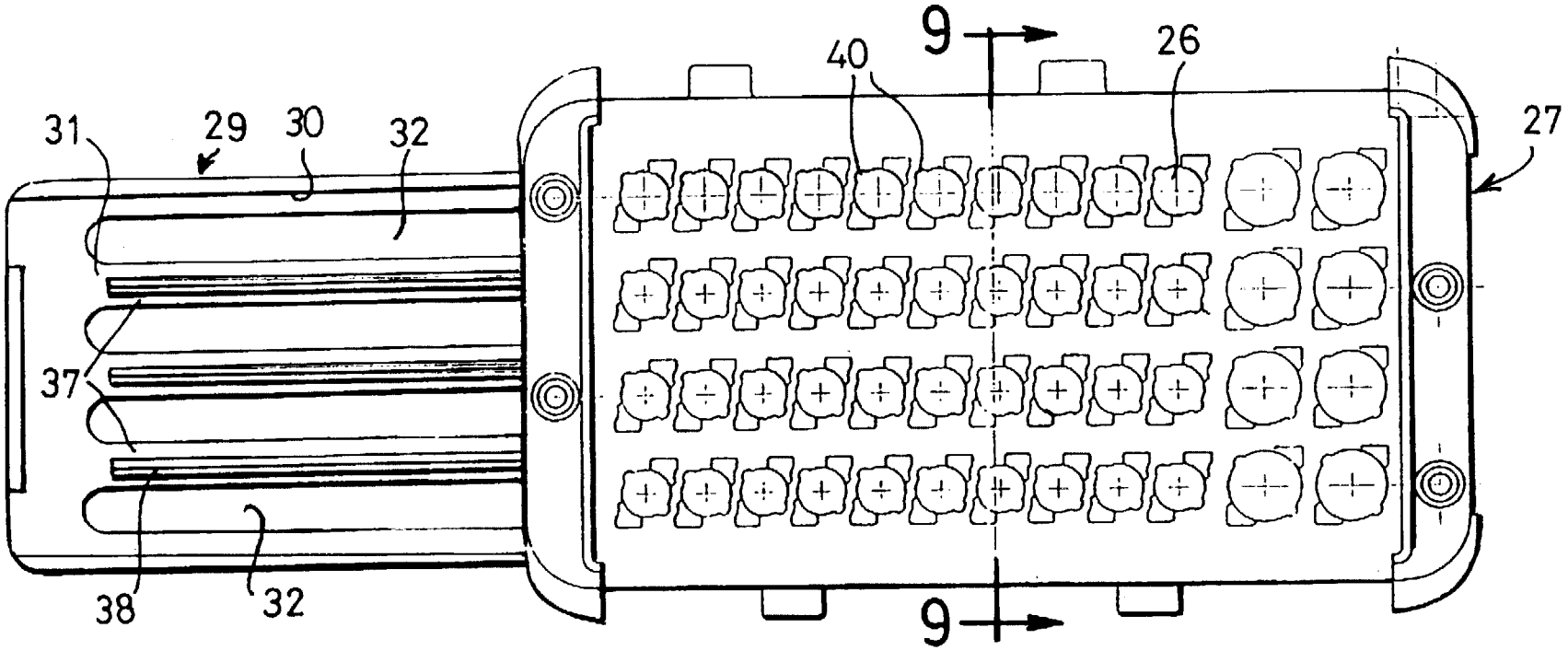
FIG. 8 is an elevational view showing the housing adapted to receive the members from FIGS. 1 through 7.
Figure 9:
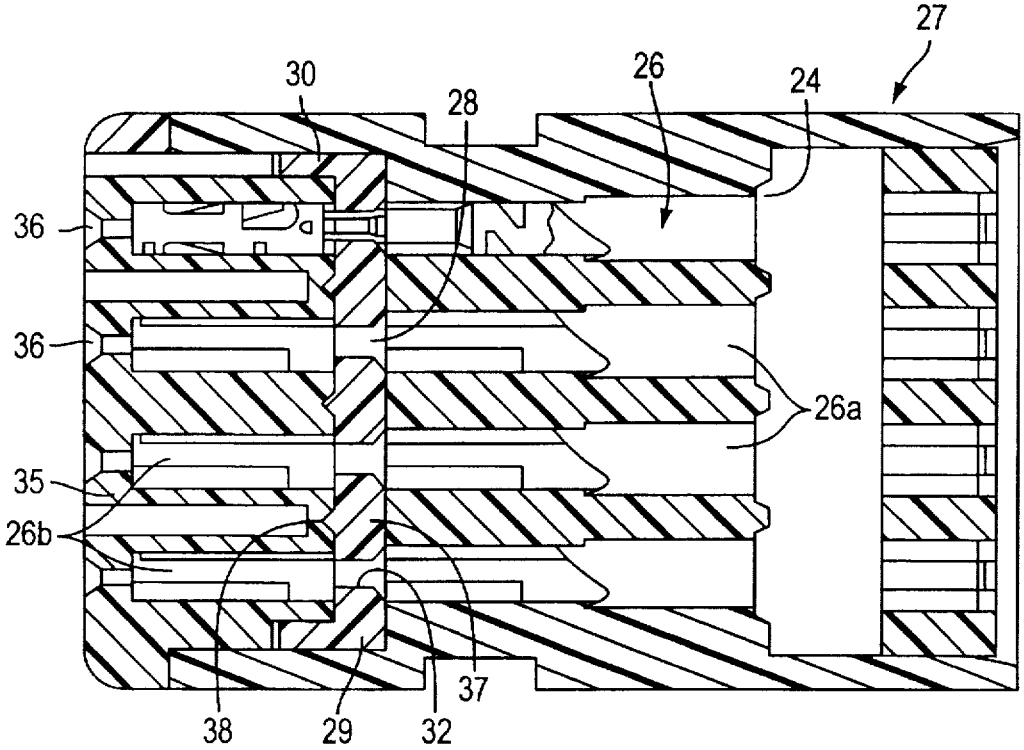
FIG. 9 is a view in section on the line 9—9 in FIG. 8.

As shown in FIG. 8, two series of passages are provided, one to receive members adapted to convey a relatively weak electrical current and the others to convey a relatively strong electrical current, the latter being larger but having a profiled part 8 having the same outside dimensions as the others.

Figure 10:
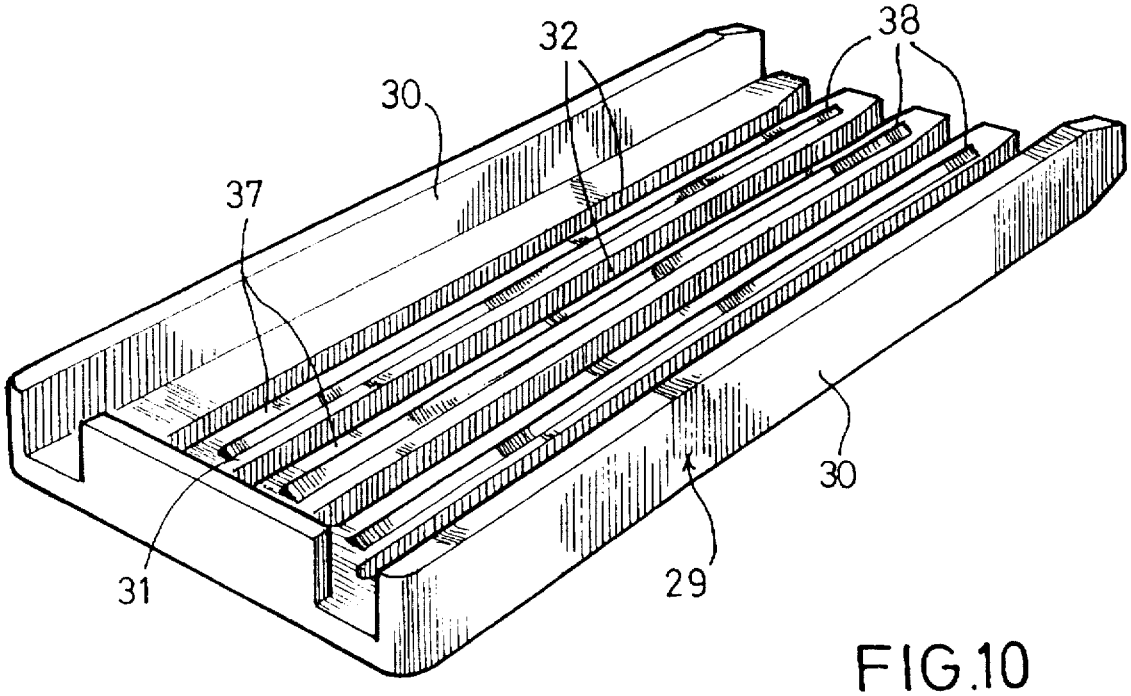
FIG. 10 is a perspective view of the key.

Partway along its length the housing member 27 incorporates a slot 28 adapted to receive a locking key 29 (see FIG. 10). The key is a plate with two lateral rims 30 and a bottom 31 incorporating slots 32.

Each slot 32 aligns perpendicularly with the passages 26.

The passages 26 have a part **26*a* between the end 24 and the slot 28 and a part 26*b* between the slot 28 and a wall 35 with perforations 36** for the male electrical contact members to pass through.

Figure 13:
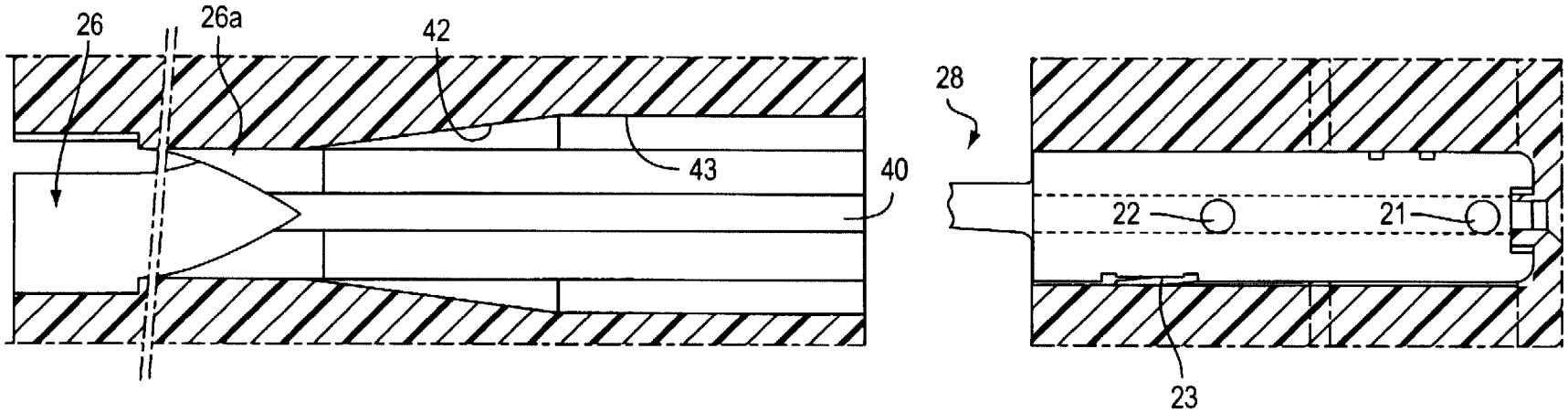
FIG. 13 illustrates the female electrical contact member in the locked position.

As illustrated in FIG. 13, the part **26*b* of the passages between the slot 28 and the wall 35 has a length corresponding to the length of the sleeves 15, the profiled part 8 locating in the slot 28, the cross-section of the profiled parts 8 corresponding to the width of the slots 32 in the key 29**.

The slots 32 delimit strips 37 which have a rib 38 cooperating with corresponding grooves in the slot 28.

Near the profiled part 8, the sleeves 15 form a shoulder so that once the members have been fitted and the key 29 has been mounted in the slot 28 the members are locked in place.

As the electrical contact members must adopt a particular angular position, in the part **26*a* and in the part 26*b* the passages 26 incorporate two longitudinal grooves 40 offset by 180° with which the stamped protrusions 21 and 22** cooperate.

The end of each passage **26*a* adjacent the slot 28 features two recesses 42 offset by 180° and which diverge in the direction towards the slot 28, each recess being extended towards the slot 28 by a rectilinear part 43**.

The distance between the bosses 21 and 22 is greater than the width of the slot 28 so that during fitting of the electrical contact member, when the bosses 21 are inserted into the grooves 40 of the parts **26*b* of the passage 26 the bosses 22 are still guided by the grooves 40 in the parts 26*a* of the passages 26**.

Figure 11:
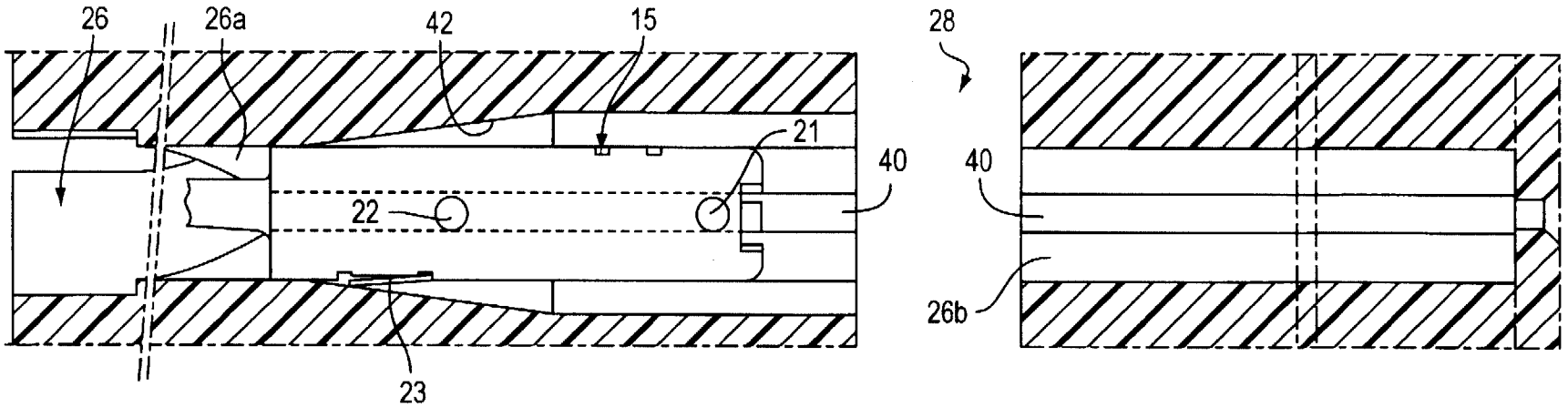
FIGS. 11 and 12 are sectional views to a larger scale showing the fitting and the demounting of the female electrical contact members.
Figure 12:
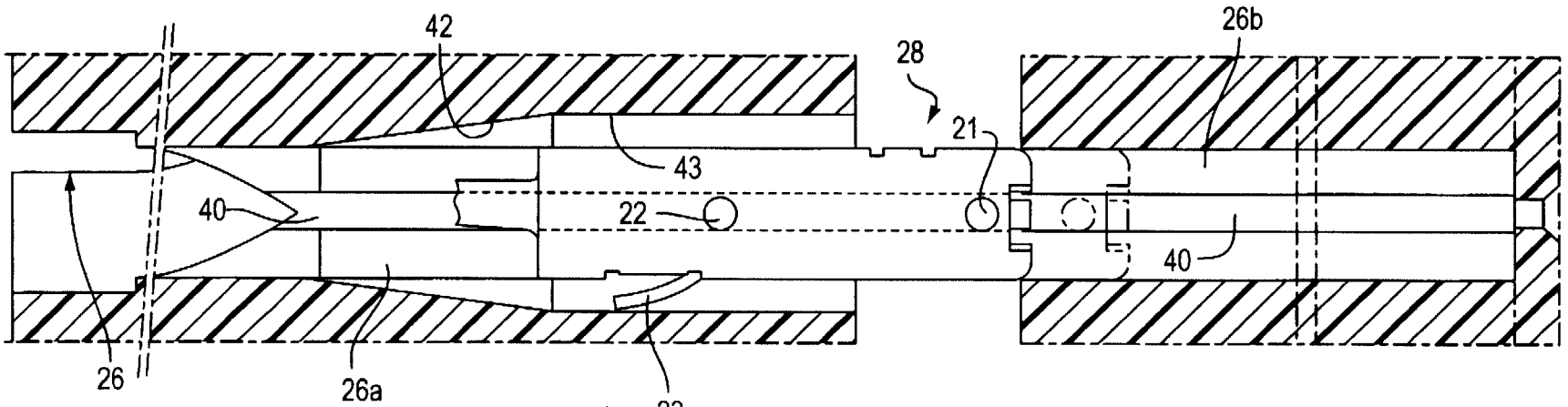

As seen in FIGS. 11 and 12, the tongue 23 constitutes a simple detent that is compressed when the electrical contact members are fitted and which reverts to its normal protruding position when it locates near the corresponding recess 42 and the rectilinear part 43.

This arrangement prevents the tongue 23 tending to push the sleeve 15 off the axis of the parts **26*a* and 26*b* of the passages 26, which makes it certain that when the electrical contact members are fitted the sleeves 15 can be inserted without difficulty into the parts 26*b***.

Similarly, if it is required to remove the electrical contact members from the passages 26, the tongues 23 will not abut against the end of the parts **26*a* of the passages 26 adjacent the slot 28 since the tongues 23 will slide freely in the rectilinear parts 43 and then, cooperating with the part 42, be deflected inside the volume of the sleeves 15**.

Each passage can include two recesses 42 extended by rectilinear part 43 and two grooves 40, with the recesses and grooves being offset by 180° so that each electrical contact member can be mounted in either of two angular positions.

Of course, the invention is not limited to the embodiment just described and shown. Many modifications of detail may be made thereto without departing from the scope of the invention.

There is claimed:

1. An electrical connector, comprising:

a housing member having a series of passages and a slot perpendicular to each of said passages, each of said passages including an insertion end adapted to receive an insertion end of a female electrical contact member, and including at least one guide slot; and a part of each passage between said insertion end of a corresponding female electrical contact member and said slot includes at least one recess which has an increasing depth in a direction of said slot;

a locking key movable in said slot and having a series of slots aligned with said passages; and a plurality of female electrical contact members, each of said plurality of electrical contact members comprising:

a first part including first and second ends, and a profiled part therebetween, said first end including a spring clamp, said second end including lugs for crimping an electrical conductor, and said profiled part being insertable in said slots in said locking key; and a second part comprising a sleeve comprising first and second ends fixed over said first part at said first end of said first part so that said insertion end comprises said first end of said second part and said profiled part is formed between said second end of said sleeve and said crimping lugs, said sleeve including elastic tongues cooperating with said spring clamp, at least one boss adapted to cooperate with said at least one guide slot of each passage, and a retaining tongue cut out from a lateral wall of said sleeve, the retaining tongue comprising a free end at said second end of said sleeve and said retaining tongue capable of being moved into and freely slidable along said at least one recess during insertion and removal of the female electrical contact member without abutting an end of said passages adjacent said slot which receives said locking key.

2. The electrical connector according to claim 1, wherein each of said passages has a longitudinal axis, and each at least one recess adjacent said slot has a lower wall that is parallel to said longitudinal axis.

3. The electrical connector according to claim 1, wherein said slot has a width, said at least one boss comprises two bosses, and a distance between said two bosses is greater than said width of said slot.

4. The electrical connector according to claim 1, wherein each passage includes two guide slots offset by 180° so that each female electrical contact member can be inserted in two different angular positions and each passage includes two recesses offset angularly by 180°.

5. The electrical connector according to claim 1, wherein said retaining tongue is compressed from a normal position when inserted into the insertion end of said passage, and reverts to the normal position when located in said at least one recess.

6. The electrical connector according to claim 5, wherein each passage includes two guide slots offset by 180° so that each female electrical contact member can be inserted in two different angular positions and each passage includes two recesses offset angularly by 180°.

7. The electrical connector according to claim 5, wherein said at least one recess includes a rectilinear part, and said rectilinear part adjacent said slot includes a wall that is parallel to a longitudinal axis of the passage.

8. The electrical connector according to claim 7, wherein each passage includes two guide slots offset by 180° so that each female electrical contact member can be inserted in two different angular positions and each passage includes two recesses offset angularly by 180°.

9. The electrical connector according to claim 5, wherein said slot has a width, said sleeve includes a second boss, and a distance between the two bosses being greater than said width of said slot.

10. The electrical connector according to claim 9, wherein each passage includes two guide slots offset by 180° so that each female electrical contact member can be inserted in two different angular positions and each passage includes two recesses offset angularly by 180°.

11. The electrical connector according to claim 7, wherein said slot has a width, said sleeve includes a second boss, and a distance between the two bosses being greater than said width of said slot.

12. The electrical connector according to claim 11, wherein each passage includes two guide slots offset by 180° so that each female electrical contact member can be inserted in two different angular positions and each passage includes two recesses offset angularly by 180°.

13. The electrical connector according to claim 1, wherein each passage includes a part between said slot and an end wall which contains said sleeve including said retaining tongue when said profiled part is positioned in said slot.

14. The electrical connector according to claim 13, wherein each of said passages has a longitudinal axis, and each at least one recess adjacent said slot has a lower wall that is parallel to said longitudinal axis.

15. The electrical connector according to claim 13, wherein said slot has a width, said at least one boss comprises two bosses, and a distance between said two bosses is greater than said width of said slot.

16. The electrical connector according to claim 13, wherein each passages includes two guide slots offset by 180° so that each female electrical contact member can be inserted in two different angular positions and each passage includes two recesses offset angularly by 180°.

17. The electrical connector according to claim 13, wherein said retaining tongue is compressed from a normal position when inserted into the insertion end of said passage, and reverts to the normal position when located in said at least one recess.

18. The electrical connector according to claim 17, wherein said slot has a width, said sleeve includes a second boss, and a distance between the two bosses being greater than said width of said slot.

19. The electrical connector according to claim 17, wherein each passage includes two guide slots offset by 180° so that each female electrical contact member can be inserted in two different angular positions and each passage includes two recesses offset angularly by 180°.

20. The electrical connector according to claim 17, wherein said at least one recess includes a rectilinear part, and said rectilinear part adjacent said slot includes a wall that is parallel to a longitudinal axis of the passage.

21. The electrical connector according to claim 20, wherein said slot has a width, said sleeve includes a second boss, and a distance between the two bosses being greater than said width of said slot.

22. The electrical connector according to claim 20, wherein each passage includes two guide slots offset by 180° so that each female electrical contact member can be inserted in two different angular positions and each passage includes two recesses offset angularly by 180°.

* * * * *